US009675114B2

(12) United States Patent
Timmermans

(10) Patent No.: US 9,675,114 B2
(45) Date of Patent: Jun. 13, 2017

(54) REAL TIME VARIABLE VOLTAGE PROGRAMMABLE ELECTRONIC CIGARETTE AND METHOD

(71) Applicant: Ludovicus Josephine Felicien Timmermans, Antwerp (BE)

(72) Inventor: Ludovicus Josephine Felicien Timmermans, Antwerp (BE)

( * ) Notice: Subject to any disclaimer, the term of this patent is extended or adjusted under 35 U.S.C. 154(b) by 693 days.

(21) Appl. No.: 14/067,007

(22) Filed: Oct. 30, 2013

(65) Prior Publication Data

US 2014/0123990 A1 May 8, 2014

Related U.S. Application Data

(60) Provisional application No. 61/723,956, filed on Nov. 8, 2012.

(51) Int. Cl.
*A24F 47/00* (2006.01)

(52) U.S. Cl.
CPC ..... *A24F 47/008* (2013.01)

(58) Field of Classification Search
CPC ..... A24F 47/002; A61M 15/06
See application file for complete search history.

(56) References Cited

U.S. PATENT DOCUMENTS

2007/0144545 A1* 6/2007 Long ..... A24C 5/3412 131/280
2009/0095287 A1* 4/2009 Emarlou ..... A61M 11/041 128/200.14
2009/0283103 A1* 11/2009 Nielsen ..... A24F 1/30 131/273
2011/0036346 A1* 2/2011 Cohen ..... A61M 15/0065 128/200.14
2012/0318882 A1* 12/2012 Abehasera ..... A61M 11/041 239/1
2013/0284192 A1* 10/2013 Peleg ..... A24F 47/002 131/329

* cited by examiner

*Primary Examiner* — Cynthia Szewczyk
(74) *Attorney, Agent, or Firm* — Notaro, Michalos & Zaccaria P.C.

(57) ABSTRACT

A real time variable voltage programmable electronic cigarette device has a main body, a controller, a memory, a visual indicator, a multidirectional joystick for operating and programming the electronic cigarette, a visual indicator for real-time status feedback, and a USB connector for computer connectivity. Programming the device includes the ability to create vaping profiles. The programmable function enables a user to set the voltage output and power output level applied to the atomizer when energized.

24 Claims, 12 Drawing Sheets

REAL TIME VARIABLE VOLTAGE PROGRAMMABLE ELECTRONIC CIGARETTE AND METHOD

CROSS-REFERENCE TO RELATED APPLICATIONS

This application claims the benefit of U.S. Provisional Application No. 61/723,956 filed on Nov. 8, 2012, which is hereby incorporated by reference in its entirety for all purposes as if fully set forth herein.

FIELD AND BACKGROUND OF THE INVENTION

The present invention relates generally to the field of electronic vaping devices and in particular to a real-time variable programmable cigarette system.

An electronic cigarette, also known as an "e-cigarette" or an "e-cig," is an electrical inhaler that vaporizes a propylene glycol- or glycerin-based liquid solution into an aerosol mist, simulating the act of tobacco vaping. It is often marketed as a vaping cessation aid or tobacco replacement.

Hon Lik, a Chinese pharmacist, is widely credited with the invention of the modern electronic cigarette. In 2000, he conceived of the idea of using piezoelectric ultrasound-emitting element to vaporize a pressurized jet of liquid containing nicotine diluted in a propylene glycol solution. This produces a smoke-like vapor that can be inhaled and provide a vehicle for nicotine delivery into the bloodstream via the lungs. He also proposed used of propylene glycol to dilute nicotine and place it into a disposable plastic cartridge which would serves as a liquid reservoir and mouthpiece. These contributions have laid the basic elements of the present day electronic cigarettes.

U.S. Patent Pub. 2011/0265806 by Alarcon teaches an electronic vaping device which includes a first sensor for detecting a user's action for vaping, an air inlet, an air flow path extending from the air inlet, a liquid compartment storing a vaping liquid, a dispensing control device configured to selectively dispense the vaping liquid from the liquid compartment, a vaporizing compartment connected to the liquid compartment and the air flow path, a heater located at the vaporizing compartment, a controller configured to activate the heater to vaporize the vaping liquid dispensed from the liquid compartment.

U.S. Pat. No. 8,402,976 to Fernando, et al. teaches an electrically heated vaping system for receiving an aerosol-forming substrate. It includes at least one heating element for heating the substrate to form an aerosol, a power supply for supplying power to the at least one heating element; electrical hardware connected to the power supply and the at least one heating element; and an interface for establishing a communications link with a host.

U.S. Patent Publication 2012/0291791 by Pradeep teaches an electronic cigarette having a breath monitor and a flow controller. The breath monitor detects user breath characteristics such as breath duration, rate, depth, and strength and adjusts the amount of nicotine delivered to the user based on user breath characteristics.

U.S. Patent Publication 2013/0104916 by Bellinger et al. teaches a power regulated electronic vaporizer for a vaping simulator device in which direct regulation of the input or output power provides a uniform and consistent user experience. The electronic vaporizer includes a heating element, a power source that provides power to the heating element, and a trigger component that activates the heating element to vaporize a material from a cartridge for consumption (e.g., inhale, smoke, and the like). The electronic vaporizer further includes a control component that is configured to adjust the power source to regulate a vaporization of the material from the cartridge for a uniform distribution to the user, wherein the adjustment is based upon a power output or a power input from a component to the heating element.

Patent Publication WO2012065754 by Fernando et al. teaches an electrically heated vaping system comprising a secondary unit capable of receiving a vaping article having an aerosol-forming substrate. The secondary unit has a heating element, an interface for connection to a primary power supply, a secondary power supply for supplying electrical power to the at least one heating element, and secondary circuitry arranged to control supply of electrical power from the secondary power supply to the heating element in a pre-heating mode, during which the temperature of the aerosol-forming substrate is increased to an operating temperature, to control supply of electrical power from the secondary power supply to the heating element in a vaping mode, during which the temperature of the aerosol-forming substrate is maintained at substantially the operating temperature, and to control charging of the secondary power supply by the primary power supply, in a charging mode, so that the secondary power supply has sufficient charge to increase the temperature of the aerosol-forming substrate to the operating temperature in the pre-heating mode and to maintain the temperature of the aerosol-forming substrate at substantially the operating temperature during the vaping mode.

U.S. Patent Publication 2012/0199146 by Marangos teaches an electronic cigarette having LED indicators to indicate the usage of the electronic cigarette as well as memory for storing and generating data and charts on the usage of the electronic cigarette.

Patent Publication WO/2012/109371 by Capuano teaches an electronic cigarette and methods for controlling the power to the electronic cigarette which provides various modes of operation, including both regulated and un-regulated mode. The method is implemented in the form of an electronic power control program that controls the constituent parts of the electronic cigarette, including the battery, atomizer, heating element, smoke liquid or juice, and related circuitry.

Accordingly, there is a need for an improved electronic cigarette, which provides enhanced adaptability, workability and user control. The present invention addresses the needs not solved by the prior art.

SUMMARY OF THE INVENTION

The present invention is a real time variable voltage programmable electronic cigarette device having the following characteristics and features.

The device has a main body having cylindrical shape. The first end is a universal atomizer connector adapted to engage a mouthpiece, and the second end is adapted to receive a cap with spring where an entrance of a power source is located. It also has an electrical control unit and a housing the electronic control unit. The housing is for electrically coupling the power source and universal atomizer connector designed to fit inside the main body.

The electronic control unit has a controller, a memory, a visual indicator, a multidirectional joystick for operating and programming the electronic cigarette, a visual indicator for real-time status feedback, and a USB connector for computer connectivity. The controller is adapted to process input data from a user. The memory is adapted to keep at least one default setting established by the user and at least one profile setting established by the user. The visual indicator is adapted for monitoring and for providing a light signal to an end user regarding a status of the device. The joystick is adapted for end user interface/control.

The USB connector is adapted to deliver firmware updates and to provide real-time monitoring by a program installed on a computer. The computer connectivity is a Micro-B USB connector exposed in the side of the main the housing. It is comprised of metal so as to serve as a complete pathway of current flow from the power source to atomizer and electronic control unit.

The joystick has a 5-direction means for directing user interface, the direction means adapted to indicate up, down, left, right and center directions. The joystick is used to switch the device on and off and is used for programming functions.

The visual indicator provides real-time status feedback from the electronic cigarette. It has a tri-color LED composed of red, green and blue, the LED being located in an upper center region of the electronic control unit. This RGB LED is adapted to combine the three colors to produce colors other than red, green and blue. The RGB LED will illuminate a default color and color movements to identify the status of device. The RGB LED is used for warnings and errors alerts, and for monitoring the status of the device. The brightness of the RGB LED depends on a strength of energy applied in the atomizer in an active vaping condition.

The mouthpiece has a tank for storing a liquid solution, and an atomizer acting as an electrical heating element. The liquid solution is an evaporable substance, namely a mixture of propylene glycol or vegetable grade fluid.

The device is programmable. Programming the device includes the ability to create waveforms and save them to one vaping profile. The programmable function enables a user to set the voltage output and power output level applied to the atomizer when energized. A desired voltage/power level setting is stored in an at least one vaping profile. The vaping profiles can be saved to the memory of the device. Part of the vaping profile is an arbitrary waveform created by a user. The device has four workable vaping profiles. These vaping profiles can be reprogrammed. The controller may be a proportional-integral-derivative controller that has the capability to reproduce arbitrary waveforms. These waveforms are oscillations and combinations of different voltage or power levels in a span of time. The voltage ranges from 0 to 8V, and the power ranges from 0 to 25 W.

Each vaping profile is limited by 12 seconds of operation in an active vaping condition, after which the electronic cigarette will automatically stop. The vaping profile is defined by 120 points and every point represents 100 ms.

The arbitrary waveforms define energy applied to the atomizer. These arbitrary waveform are any type of waveforms inside of the parameters of time 12 s (120 points/100 ms per points) and amplitude (0 to 8V for a voltage waveform, 0 to 25 W for power waveform).

The user can make personal vaping profile settings, create his own unique waveforms, with the support of a computer software application.

The computer application has a file system which is adapted to store the program, settings and vaping profiles. The programming options comprise stand-alone programming (i.e., on the device itself) and programming through a computer.

The PC programming function for programming using a computer employs computer application software. The PC application allows the creation of arbitrary waveforms in the range of 12 s, and 8V/25 W. The standalone programming means for programming using the device itself uses joystick. In standalone programming, the complete vaping profile is increased or decrease by steps (0.1/0.3 W) or progressively until it reaches the maximum (8V/25 W) or the minimum values (0V/0 W).

The user can define whether they wish to use a vaping profile defined in terms of voltage or terms of power. The user can define any type of electrical waveform within the specified ranges using the PC application. The user can define the name and description of the profile with the PC software application.

A vaping profile can be run in one of two styles or modes, a standard vaping mode and a real time vaping mode. The electronic cigarette is configured in standard vaping mode or real time vaping mode using the PC software application or by a sequence combination applied by the joystick. The vaping profile is in standard mode when the atomizer receives the amplitude in voltage of power as far the joystick is activated.

The vaping profile is in real time vaping mode when the atomizer receives the amplitude in voltage of power as far the joystick is pushed in the center, left or right. When the user pushes the joystick up or down, the device holds the actual vaping point, and from that time onward the user can modulate the energy applied to the atomizer increasing (joystick up), decreasing (joystick down) or holding the energy (joystick center, right or left).

Regarding the connection between the light indicator and the vaping profile, the vaping profile defines the light color while it is activated. The vaping profile has a maximum duration of 12 seconds, defined by 120 points, providing 100 ms per point, each point can be defined by any combination of RGB color model e.g., (red 0 to 255, green 0 to 255, blue 0 to 255). The user can define the color per each point using the PC software application.

Accordingly, the present electronic cigarette system provides enhanced adaptability, workability and user control, by way providing, among other features, the ability to create arbitrary waveforms which may be saved to a user profile.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

It will be understood that the present invention includes any combination of these the various features of novelty which characterize the invention and any combination of equivalent features. The embodiments which follow are presented for the purposes of illustration only and are not meant to limit the scope of the present invention. Thus, all the features of the embodiments which follow are interchangeable so that each of element each embodiment may be applied to all of the embodiments taught herein.

DESCRIPTION OF THE PREFERRED EMBODIMENTS

Figure 1:
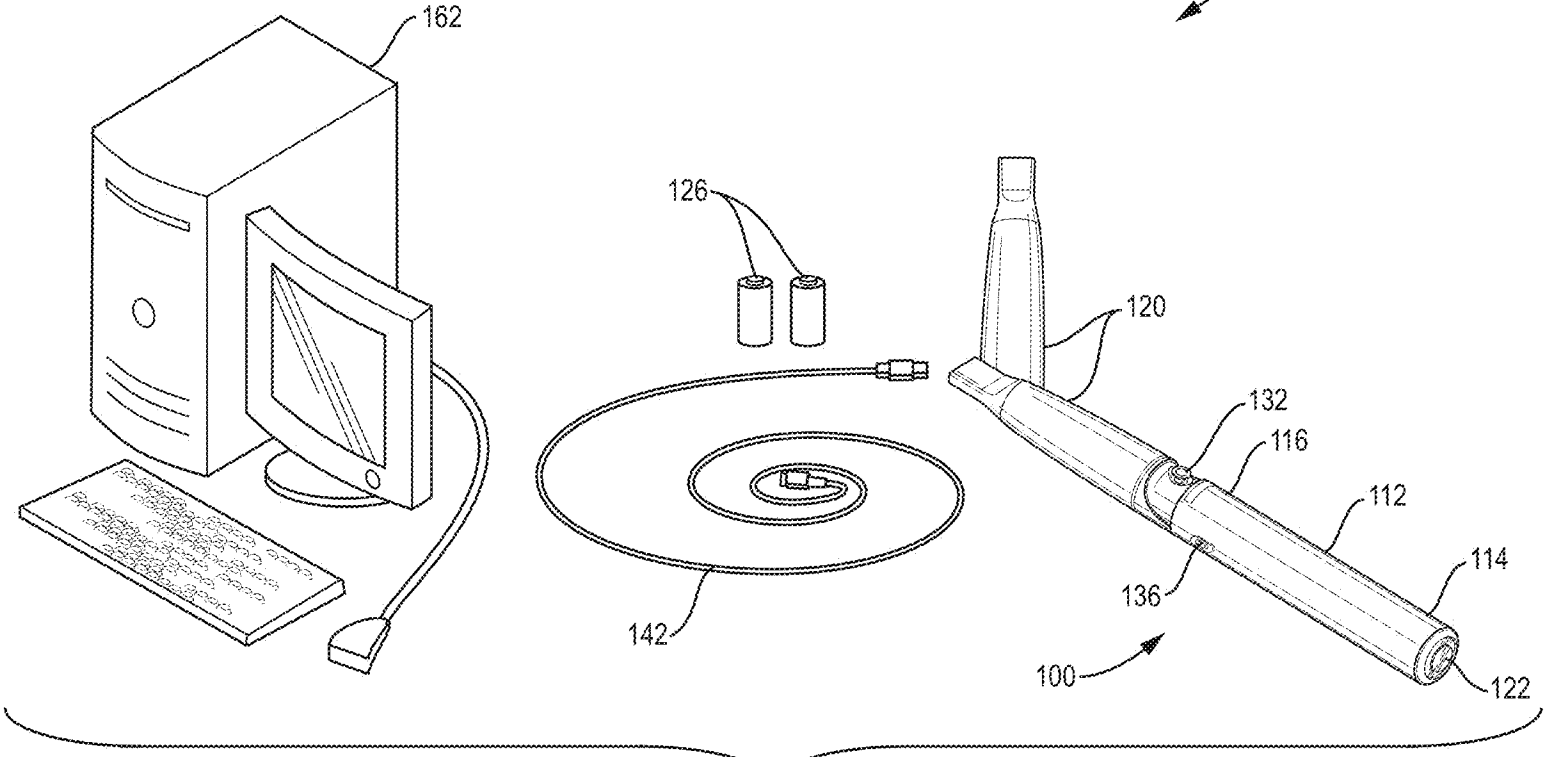
FIG. 1 depicts an overview of the real-time variable programmable cigarette system.
Figure 2:
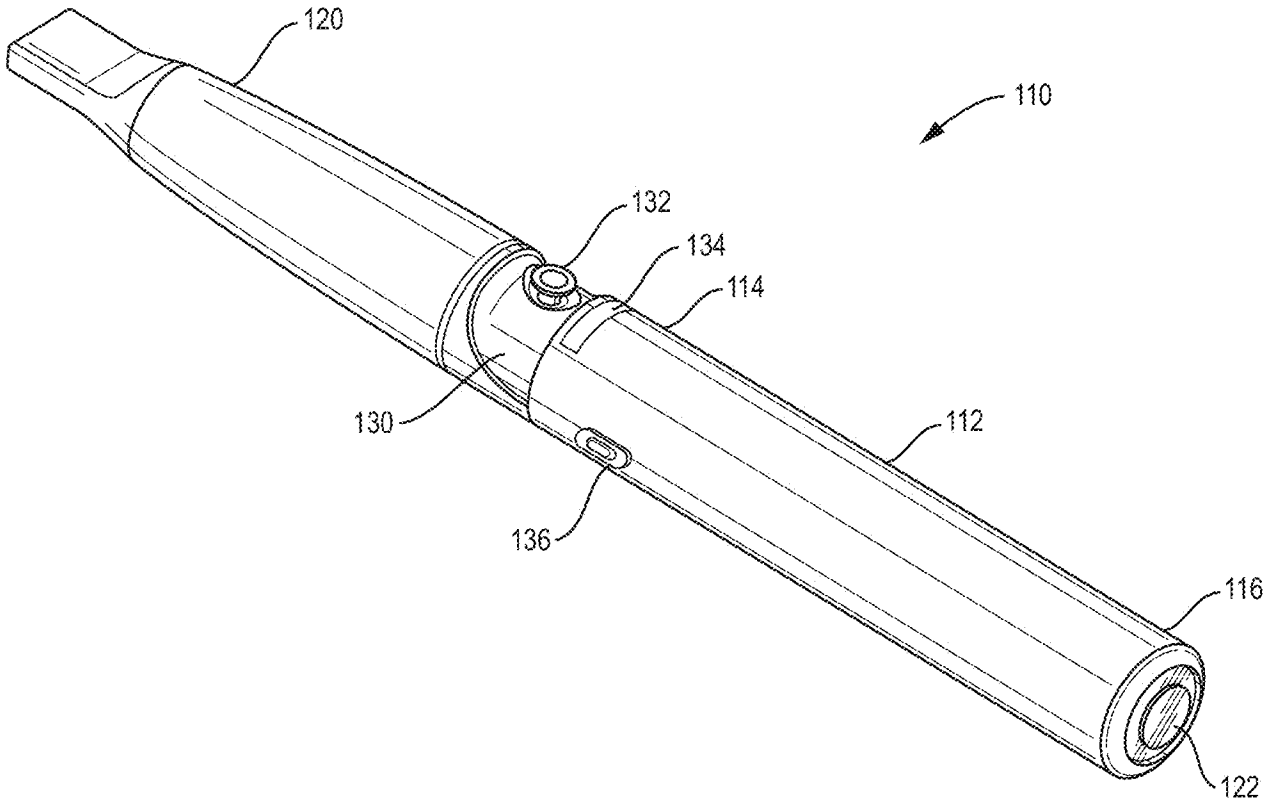
FIG. 2 is a top perspective view of the programmable cigarette.
Figure 3:
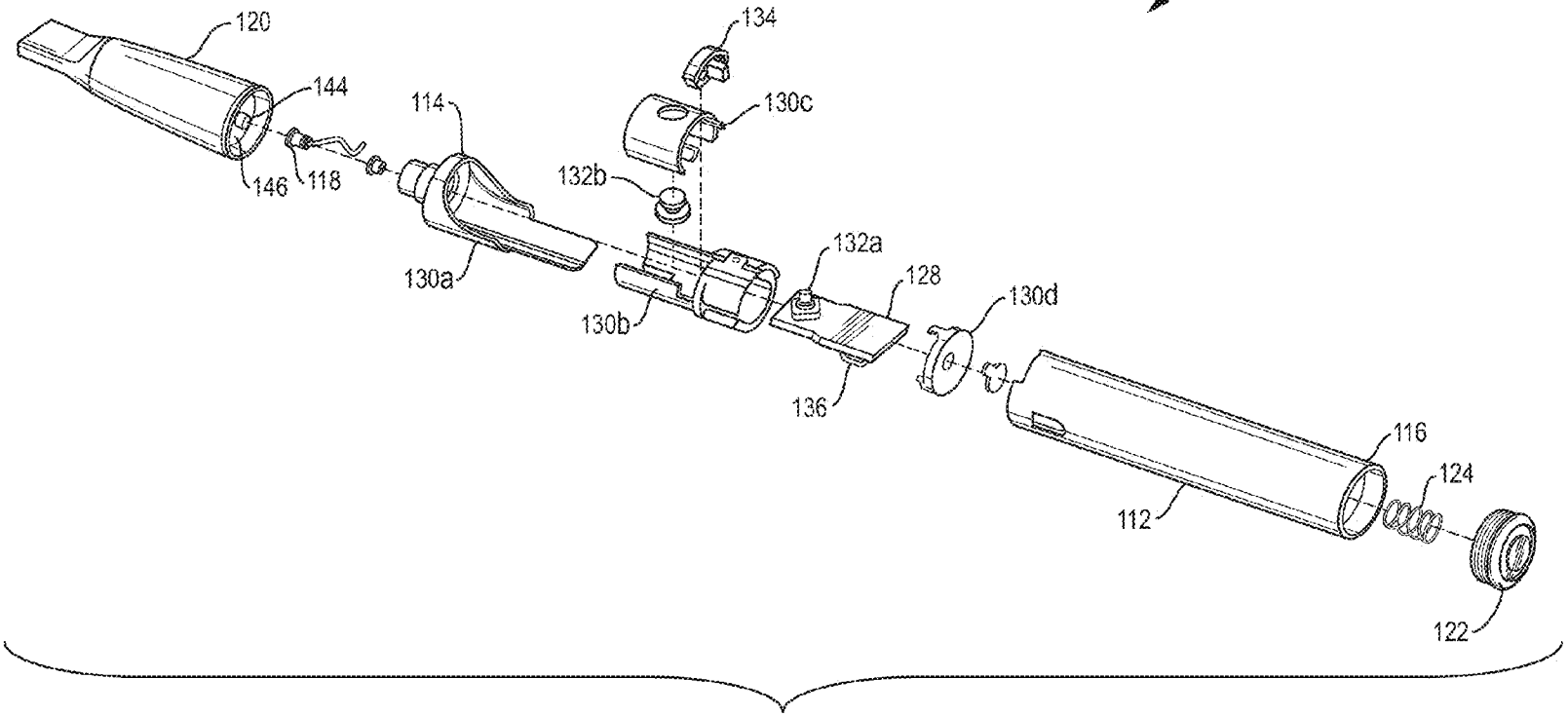
FIG. 3 is an exploded view of programmable cigarette depicted in FIG. 2.

Referring now to the drawings, in which like reference numerals are used to refer to the same or similar elements, FIGS. 1-3 show a real time real-time variable programmable electronic cigarette system 100.

With reference to FIGS. 1-3 the system 100 includes a real time variable voltage programmable electronic cigarette 110, which includes a main body 112 having cylindrical shape, a first end 114 and a second end 116, the first end 114 having an atomizer connector 118 adapted to engage a mouthpiece 120, and the second end being adapted to receive a cap 122 with spring 124 where an entrance of a power source 126 is located. The device includes an electronic control unit 128. A housing 130 holds the electronic control unit 128 and also functions to electrically couple the power source 126 and universal atomizer connector 118, and is designed to fit inside the main body 112. As best shown in FIG. 3, the housing 130 has a forward portion 130*a*, a rear portion 130*b*, joystick cover portion 130*c* and a rear cap portion 130*d*, that, when assembled, enclose the control unit 128 and the joystick 134. The main body 112 may be constructed from a metal which forms a common electrical ground for the power source 126 and the electronic control unit 128.

The electronic control unit 128 includes a multidirectional joystick 132 for operating and programming the electronic cigarette 110, a visual indicator 134 for real time status feedback, a USB connector 136 exposed from the main body 112 and provides computer connectivity via USB cable 142. The electronic control unit 128 also includes a controller 138, and a memory 140. The USB connector 136 may be one of any variety of USBs, including, but not limited to Micro B USB.

The joystick 132 allows a user to control various functions, as discussed in greater detail below. The joystick 132 is adapted to be directed in multiple directions. The directions include, but are not limited to: up, down, left, right and center directions. The joystick 132 can be used to switch the electronic cigarette 110 on and off, as well as for programming functions. Thus, the joystick 132 is included to facilitate user interaction, operating and programming. It is adapted to deliver input data from a user by being pressing in any one of a plurality of directions. The joystick 132 enables a variety of user-directed functions including, but not limited to profile 156 switching, profile 156 programming, mode 164, 166 switching (see FIG. 14), electronic cigarette 110 monitoring and electronic cigarette 110 shutdown. As best shown in FIG. 3, the joystick 132 has a shaft portion 132*a* and plastic extension button portion 132*b* exposed in the top of the main body 112. It is also within the scope of the invention for the joystick to be one continuous piece.

The controller 138 processes input data from a user, delivered from the joystick 132. The controller 138 may be microcontroller, proportional-integral-derivative controller or any other suitable controller having the capability to produce and reproduce arbitrary waveforms 168, including but not limited to fuzzy logic, sliding controller, and state feedback.

The visual indicator 134 provides provide a light signal to the user regarding a status of the electronic cigarette 110. The visual indicator 134 provides real-time status feedback from the electronic cigarette 110. The visual indicator 134 includes a tri-color LED which may be composed of red, green and blue, the visual indicator 134 is ideally located in an upper center region of the electronic control unit 128, but other convenient locations are also within the scope of the invention. Other types of visual indicators, besides tri-color LEDs, may be used and are contemplated as within the scope of the present invention. The tri-color LED is preferably an RGB LED adapted to combine the three colors to produce colors other than red, green and blue. The visual indicator 134 illuminates a default color and illuminates colors in a pattern to identify the status of the electronic cigarette 110. The visual indicator 134 is used for warnings and errors alerts. The brightness of the colors shown on the visual indicator depends on a strength of energy applied to the atomizer 144 by a user.

The visual indicator 134 has a transparent plastic piece used to reflect a light emitted outside the main body 112. The visual indicator 134 is located proximate to the joystick 132, and adapted to provide visual feedback regarding the status of the electronic cigarette 110. The visual indicator 134 provides a reflection of information received from the controller 138 based on the instructions given by the joystick 132.

The memory 140 keeps at least one default setting established by a user and at least one vaping profile 156 setting established by a user. The memory 140 saves information communicated by movement of the joystick 132.

The USB connector 136 serves, among other functions, as a means for receiving firmware updates and for providing real-time monitoring by a computer application 162.

The device has a mouthpiece 120 shaped and designed to fit comfortably the mouth of the user and to provide a path for a gaseous product of the electronic cigarette 110. The mouthpiece 120 further includes an atomizer 144 and a tank 146. The mouthpiece 120 may be fixed to the main body, continuous with the main body or detachably connected to the main body 112.

The tank 146 is capable of storing an evaporable substance. The atomizer 144 is adapted to act as an electrical heating element. According to the invention, heated air is directed into proximity with an evaporable substance located in the tank 146. At least a portion of the evaporable substance boils and produces a vapor, the vapor exiting the main body 112 by way of the mouthpiece 120. The electronic cigarette 110 according to the invention may be used with any evaporable substance, including, but not limited to propylene glycol, a vegetable grade fluid, or a mixture thereof. Other evaporable fluids may be used in accordance with the present invention.

The first end 114 of the main body 112 is threaded such that the atomizer 144 can be screwed and unscrewed into it. The second end of the main body 112 is threaded such that the cap 122 with spring 124 can be screwed and unscrewed into it. The second end of the main body 112 also defines an aperture adapted to fit the power source 126 and to be closed with the cap 122. The cap 122 is built with spring 124 for electrically coupling the power source 126 and the main body 112. The cap 122 with spring 124, therefore, secures the power source 126 while the electronic cigarette 110 is in operation.

The housing 130 comprises metal so as to provide a complete pathway of current flow from the power source 126 to the atomizer 144 and electronic control unit 128.

According to the invention, the power source 126 may be a replaceable battery or a rechargeable battery. It is preferable that the power source 126 have a voltage of at least 7.4 volts.

Figure 4:
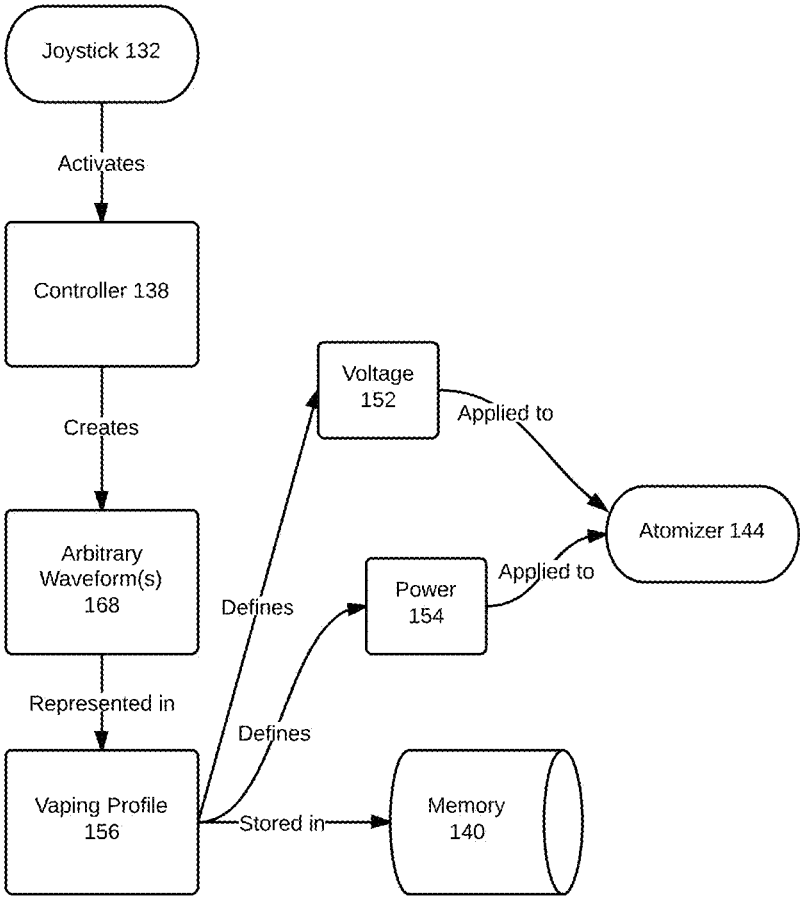
FIG. 4 is a flow chart showing the creation and storing of vaping profiles by activation of the joystick, and the activation of the atomizer in accordance with the vaping profile

With reference to FIG. 4, the controller 138 has the ability to create arbitrary waveforms 168 and save them to at least one vaping profile 156, upon activation by the joystick 132. The desired voltage 152 setting or a desired power 154 setting may be stored in a vaping profile 156. The voltage 152 and power 154 may then be applied to the atomizer 144. One or more vaping profiles 156 may be saved to the memory 140. Part of the vaping profile 156 is defined by at least one arbitrary waveform 168 created by a user. According to the invention, at least four adjustable vaping profiles 156 may be created. At least one of the vaping profiles 156 can be reprogrammed.

Figure 9:
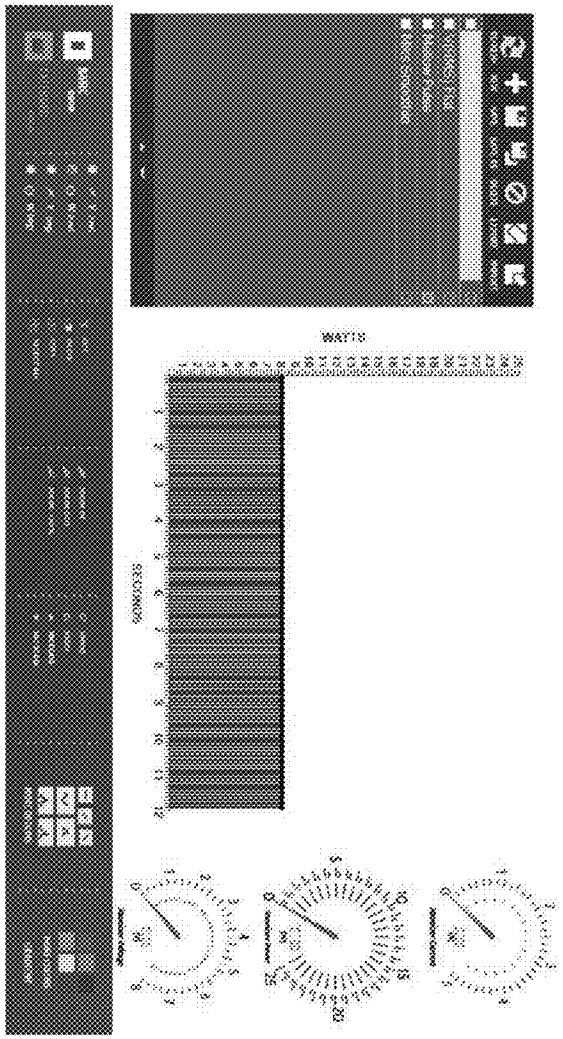
FIG. 9 depicts the Extended Editor display feature of the computer program according to the invention.

As shown in FIG. 9, the arbitrary waveforms 168 are oscillations and combinations of different levels of voltage 152 or power 154 in a span of time, wherein the voltage 152 ranges from 0 to 8V, and the power 154 ranges from 0 to 25 W. Each vaping profile 156 is limited by 12 seconds of operation in an active vaping condition 158, after which the electronic cigarette 110 will automatically stop. The vaping profile 156 is defined by 120 points and every point represents 100 ms. The arbitrary waveforms 168 define the energy applied to the atomizer 144, the energy energizing the atomizer 144, and wherein arbitrary waveforms 168 are any type of waveforms 168 inside of the parameters of time 12 s (120 points/100 ms per points) and amplitude (0 to 8V for a voltage waveform, 0 to 25 W for power waveform). The arbitrary waveform 168 defines an option for a user to define whether a vaping profile will be defined in terms of voltage 152 or in terms of power 154. A user can define any desired waveform 168 within the definable voltage 152 and power 154 ranges using a computer application 162. A user can set personal vaping profile 156 settings and create unique waveforms 168, with the support of a computer application 162. It is within the scope of the invention for the computer application 162 to include a file system which stores computer application 162 settings and vaping profiles 156.

The vaping profile also defines a color of a light shown from the visual indicator 134 while the visual indicator 134 is activated. As noted, the vaping profile has a maximum duration of 12 seconds, the 12 seconds being defined by 120 points at 100 ms per point. Each point is defined by a color according to the RGB Color Model. The electronic cigarette 110 allows a user to define a color for each point using the computer application 162.

According to the invention, there are multiple programming options, including stand-alone programming on the electronic cigarette 110 and programming through a computer application 162. Standalone programming entails programming by the joystick 132. Standalone programming includes increasing or decreasing the complete vaping profile 156 by steps (0.1/0.3 W) or progressively until it reaches the maximum (8V/25 W) or the minimum values (0V/0 W).

The computer application 162 provides the ability to set a vaping profile 156 which allows controlling the dynamic of a puff, through an arbitrary waveform of voltage 152 ($V_{avg}$, $V_{RMS}$) or power 154 ($W_{avg}$, $W_{RMS}$) on an editable time line of 0-12 seconds. The editable timeline allows a user to fully control every 1/10 second of the puff, which corresponds to a total of 120 vaping points.

Although the electronic cigarette 110 according to the invention may be used with a computer application 162, the electronic cigarette 110 is capable of storing at least four vaping profiles 156 in a memory 140, that can be selected on the device itself without the need for connection to a computer or outside machine.

Figure 12:
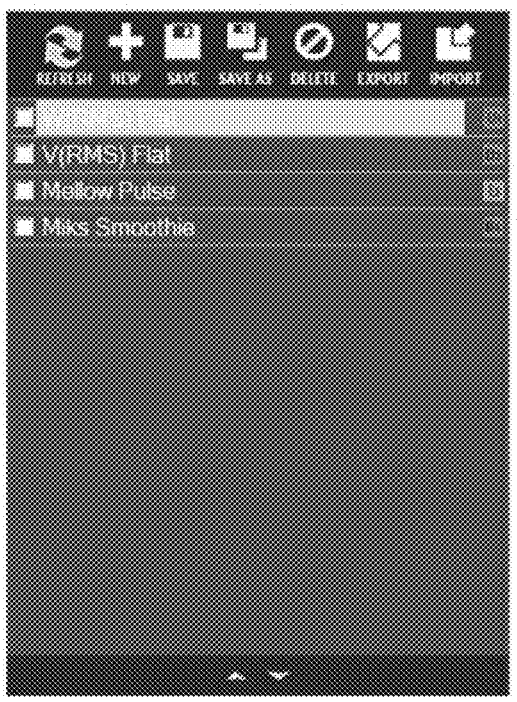
FIG. 12 depicts the profile naming feature of the computer program according to the invention.

Each vaping profile 156 may be given a name and description (see e.g. FIG. 12). The user can define the name and description with the computer application 162. The electronic cigarette 110 may have any number of profiles 156, and in, any event, at least four vaping profiles 156.

The electronic cigarette 110 according to the invention may store a wide range of information in memory 140, including, but not limited to firmware version, PCB version, product part numbers, product serial number, product name, product owner, product nick name and password.

The memory 140 can store information related to safety signals, including, but not limited to voltage level, temperature level, atomizer current level, atomizer resistance level, and atomizer driver temperature.

The memory 140 can also store use statistics, including, for example, statistics regarding the number of puffs taken by a user.

It is within the scope of the present invention to employ an encrypted license management to lock or unlock electronic cigarette 110 features.

Figure 14:
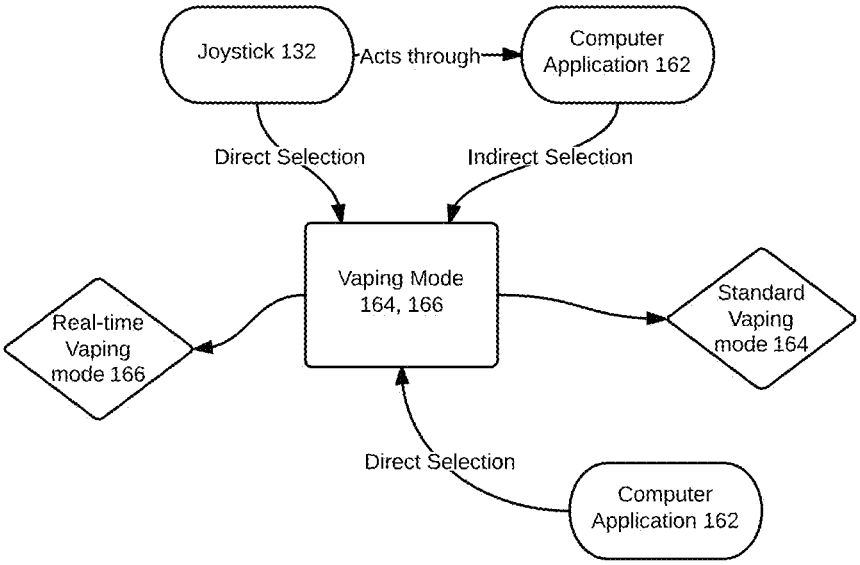
FIG. 14 is a flow chart showing the feature in which the vaping profile can be run in one of two modes.

As shown in FIG. 14, vaping profile can be run in one of two modes 164, 166. The two modes are a standard vaping mode 164 and a real time vaping mode 166. The electronic cigarette 110 is configured in standard vaping mode 164 or real time vaping mode 166 using the computer application 162 or directly by a sequence combination applied through the joystick 132. The vaping profile is in standard mode 164 when the atomizer 144 receives an increase in voltage 152 and/or of power 154 by activation through the joystick 132. The vaping profile is in real-time vaping mode when the atomizer 144 receives an increase in voltage 152 and/or power 154 depending on the degree to which the joystick 132 is pushed in the center, left or right. In practice, when the user pushes the joystick 132 up or down, the electronic cigarette 110 holds a default setting, and from that time onward the user can modulate the power and/or voltage applied to the atomizer 144, by increasing (joystick 132 up), decreasing (joystick 132 down) or holding the energy (joystick 132 center, right or left).

Thus, any joystick 132 activation will start the vaping profile 156. The vaping profile 156 will be enabled and therefore running as long as any joystick activation 32 is occurring or the vaping profile 156 expires. When the vaping profile 156 is running the visual indicator 134, will show the color defined by the vaping profile 156.

The electronic cigarette 110 works in conjunction with a computer application 162. FIGS. 5 to 13 show features of the computer application 162. The computer application 162 produces a menu, which includes drop-down menus named "Home," "Community," "Device," "Profile," and "Monitoring". "Home" directs to the software homepage and is by default this first page you will seen when the application 162 is activated. This is a dynamic homepage that shows offers, upgrades, and useful info from product vendors. "Community" directs to a user community, which allows users to share and download vaping profiles 156 and to participate in a user forum. "Device" directs to an application 162 feature which allows for the setting of global device settings of the electronic cigarette "Profile" directs to an application 162 feature which allows for editing, programing, uploading, downloading and fine tuning of the electronic cigarette 110 settings. "Monitoring" directs to an application 162 feature which allows for real-time observation of electronic cigarette 110 activity, including changes effectuated by activation through the joystick 132. It is within the scope of the invention to include additional menus know in the field.

The present invention adaptable for implementation with a website, accessible through the "Community" menu. One function of the website is to provide a forum for a community for sharing, searching, uploading and downloading vaping profiles. Users may, among other features, create groups, establish friends and show user activity. The website also provides the ability to download the latest version of the computer application 162 and firmware software. The website also allows a user to view information regarding existing, registered devices. Additionally the website may provide for on-line purchases of licenses to unlock features of the device.

The application 162 allows navigating within vaping profiles 156 for adding, saving, deleting, exporting and importing vaping profiles 156. The application 162 according to the invention has a visual editor for the editing vaping profiles 156 for editing features of the waveforms 168, including, but not limited to, shape and color.

Thus, the computer application 162 allows for monitoring the activity of the electronic cigarette 110 while a user is vaping, and provides information regarding the atomizer 144 including voltage, power, current, resistance, temperature, battery voltage and battery life.

Figure 11:
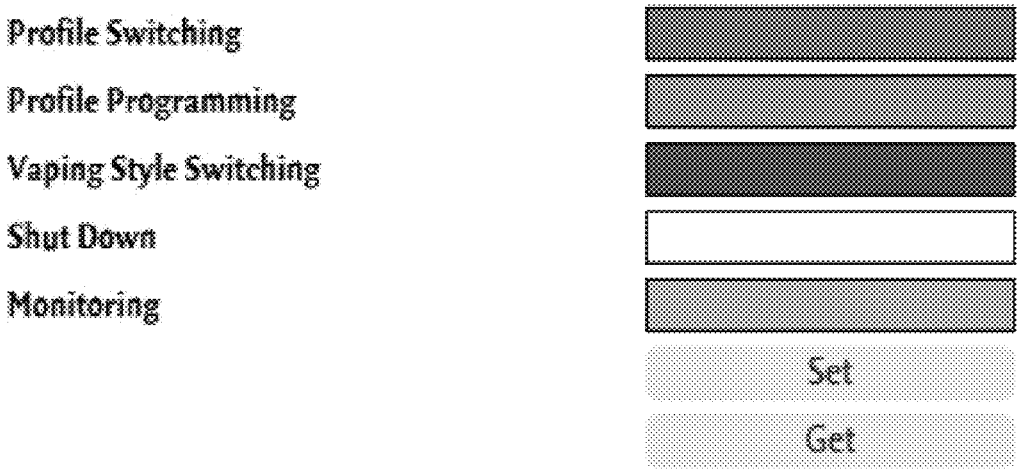
FIG. 11 depicts the "State Color" menu option feature of the computer program according to the invention

The software application 162 also provides a "State Color" menu option which allows a user to set the colors which the user desires to be displayed during various operations. As shown in FIG. 11, these operations include, but are not limited to Profile Switching, Profile Programming, Vaping Style Switching, Shut Down, and Monitoring.

Figure 5:
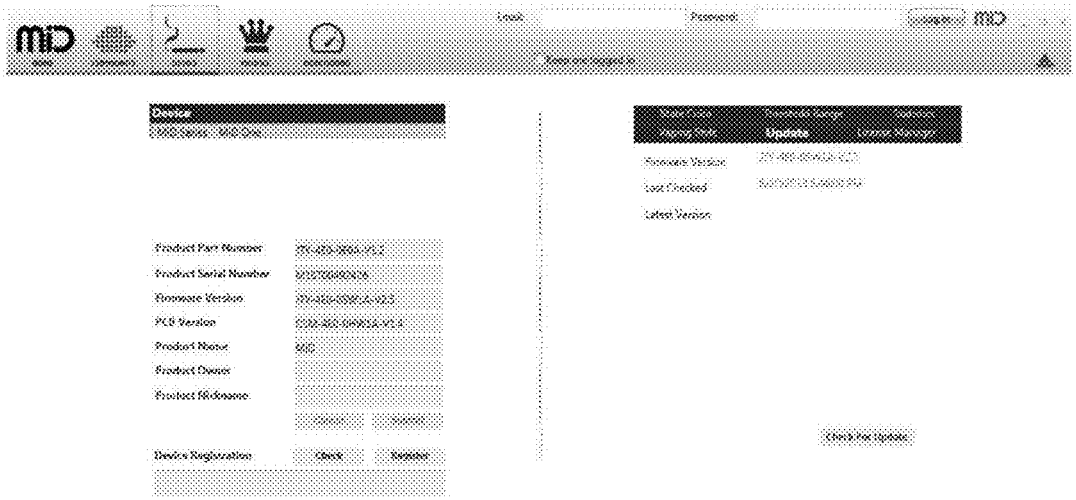
FIG. 5 depicts the homepage display of the computer program according to the invention.

The "Statistics" menu option shown in FIG. 5 shows the user information regarding the number of puffs taken since the time the power source 126 was inserted into the electronic cigarette 110.

Figure 6:
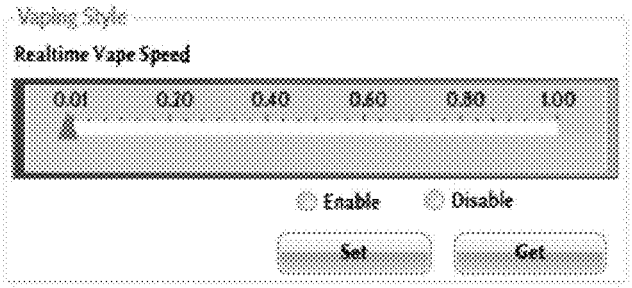
FIG. 6 depicts the Vaping Style selection feature of the computer program according to the invention.

As shown in FIG. 6, the software application 162 also provides access to a Vaping Style module. The Vaping Style module defines how fast the joystick will boost the settings of a vaping profile 156 setting. Low values reflecting slow boosting, and high values reflect fast boosting. The lowest value is 0.0, and the highest value is 1.00. In operation, a user will enter the desired value and press "Set". Pressing "Get" will collect the current values from the electronic cigarette 110 and display them. There are also Enable and Disable radio buttons which allow a user to choose whether to enable or disable this module at all. Selecting "Set" activates a user's choice.

Figure 7:
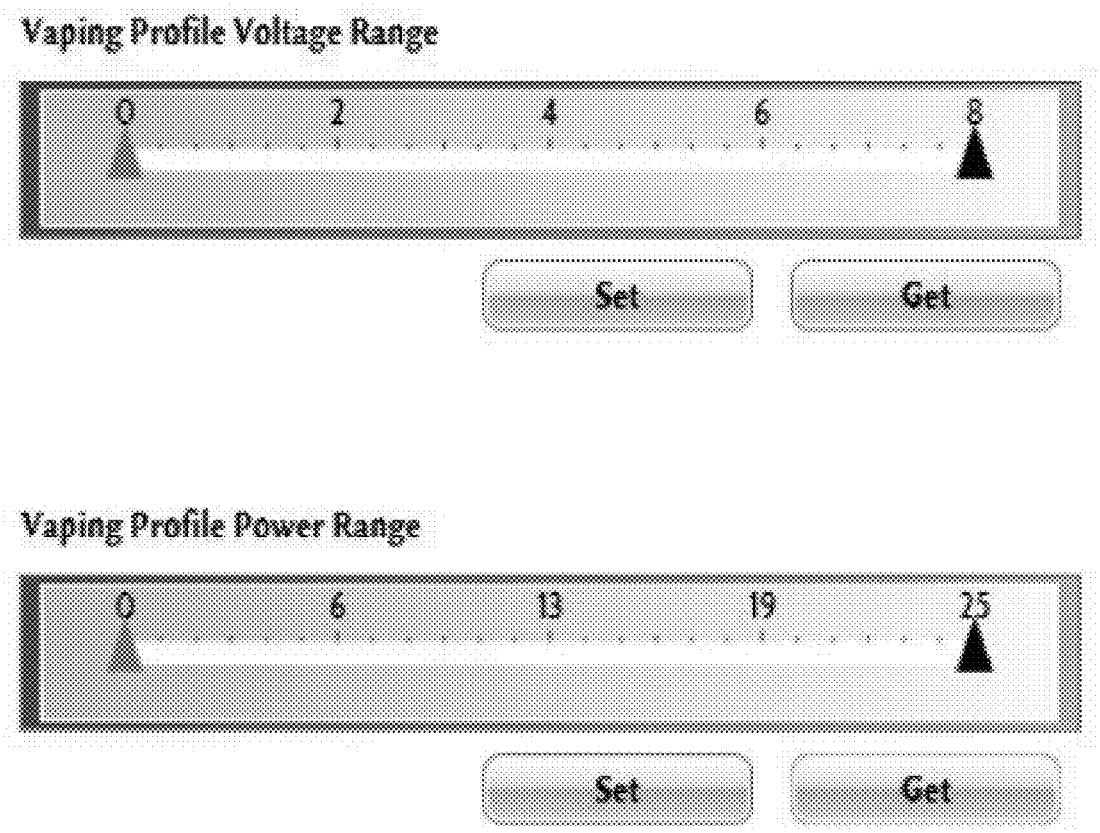
FIG. 7 depicts the Vaping Profile Voltage Range and Power Range selection features of the computer program according to the invention.

It can be seen in FIG. 7 that the software allows a user to control the voltage 152 and power 154 ranges in which the electronic cigarette 110 will operate.

Figure 8:
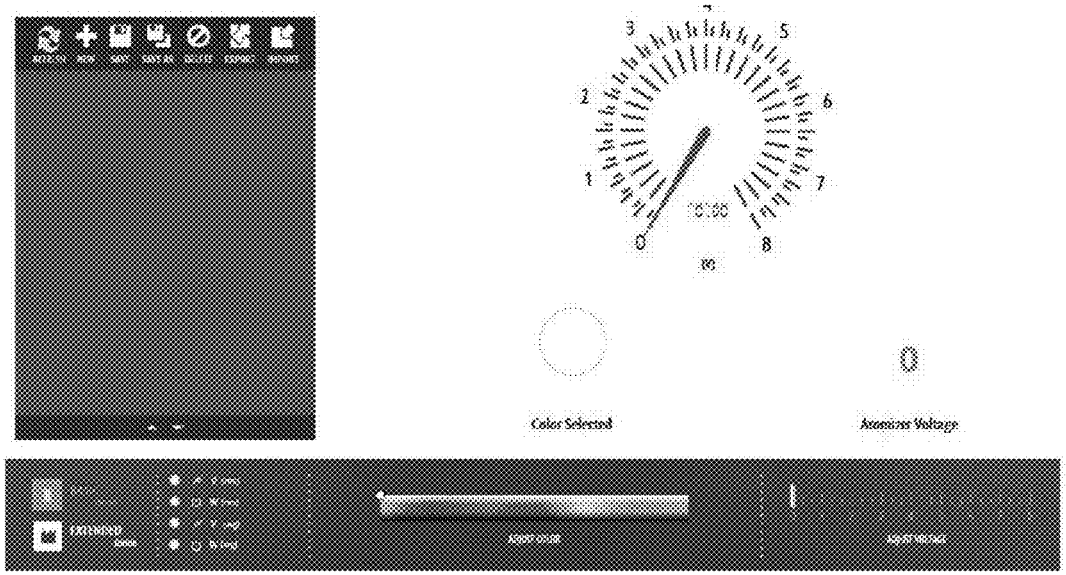
FIG. 8 depicts the Basic Editor display feature of the computer program according to the invention.

FIG. 8 shows the features of the Basic Editor feature of the application 162 accessible when the Profile button of FIG. 5 is selected. The circular gauge shows a value selected from the group which includes $V_{rms}$, $W_{rms}$, $V_{avg}$, and $W_{avg}$. The Color Selected bar shows the color selected for the profile 156 being displayed. There is an Adjust Voltage selector for setting the voltage 152 of a profile 156. When the "Refresh" button is pressed, a list of profiles 156 saved on the electronic cigarette 110 will be shown, as shown in FIG. 12.

FIG. 9 shows the features of the Extended Editor feature of the application 162 accessible when the Extended Editor button of FIG. 8 is selected. In addition to the features of the Basic Editor, the Extended Editor has a toolbox for selecting, cutting, copying, and pasting vaping profile 156 data, a box for zooming in and out of the profile 156 editing area, a toolbox which allows for undoing, redoing, increasing and decreasing an action already taken. There is a feature for creating custom figures in the profile 156 edit area. There is a box for selecting the color of a particular profile. Along the right, there are three gauges which show, respectively, atomizer voltage, atomizer power, and atomizer current in real time, from the moment the joystick 132 is activated, until a user releases the joystick 132. This provides a real-time monitor useful when a user is creating a profile 156. In the middle is a profile 156 edit area. Along the Y-axis is power (0 to 25 Watts). Along the X-axis is the profile's timeline 0 to 12 seconds). The power at every 1/10 of a second may be controlled.

Figure 10:
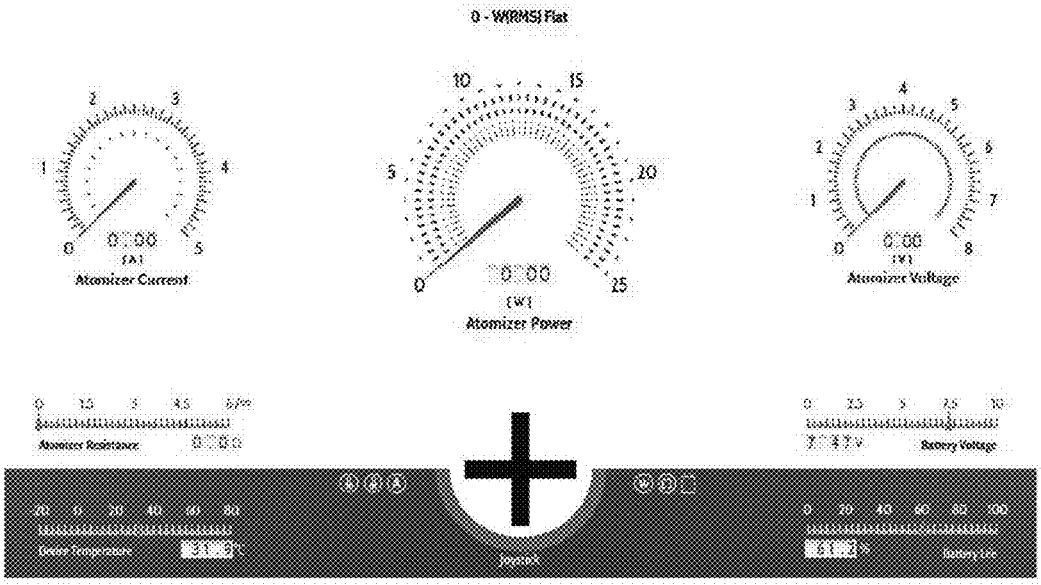
FIG. 10 depicts the Monitor display feature of the computer program according to the invention.
Figure 13:
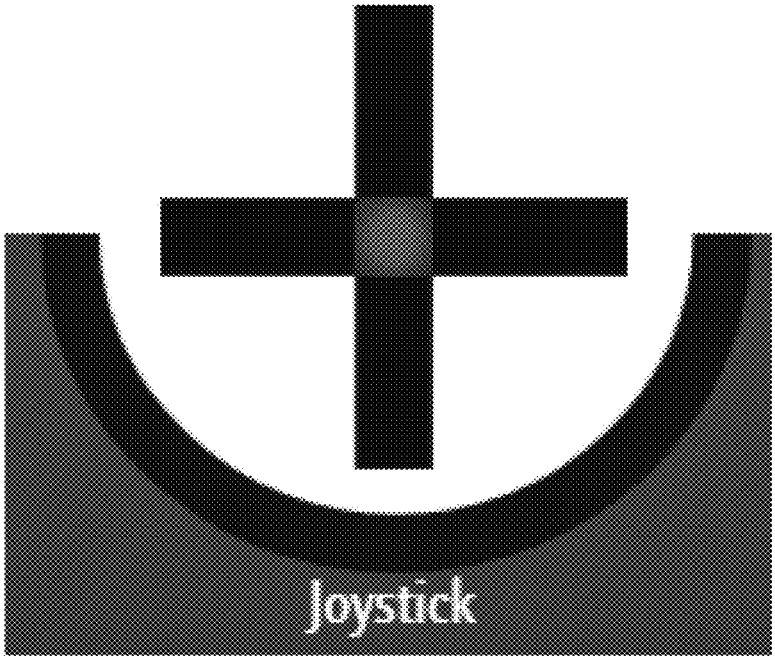
FIG. 13 depicts a detailed view of the features of the joystick monitoring aspect of the Monitor feature.

FIG. 10 shows the features of the Monitoring feature of the application 162 accessible when the Monitoring button of FIG. 5 is selected. The Monitoring page shows information regarding atomizer current, atomizer power, atomizer voltage, atomizer resistance, battery voltage, device temperature, and battery life. This list of features is merely exemplary and it is within the scope of the invention to display any additional monitoring information that is known in the field to be relevant to monitoring the status of an electronic cigarette. As shown in FIG. 13, the Monitor has a cross, which is a visual representation of the joystick. The "U" shaped arch underneath the cross, represents a color of the visual display 34 of the electronic cigarette 110. Once the electronic cigarette 110 is activated, the cross will have a small colored square on it, indicating where a user is directing the joystick. At the same time the "U" shape will light up in the color the user has programmed the visual display 34 to show when the profile is running.

While a specific embodiment of the invention has been shown and described in detail to illustrate the application of the principles of the invention, it will be understood that the invention may be embodied otherwise without departing from such principles. It will also be understood that the present invention includes any combination of the features and elements disclosed herein and any combination of equivalent features. The exemplary embodiments shown herein are presented for the purposes of illustration only and are not meant to limit the scope of the invention. Thus, all the features of all the embodiments disclosed herein are interchangeable so that any element of any embodiment may be applied to any of the embodiments taught herein.

What is claimed is:

1. A real time variable voltage programmable electronic cigarette system (100), comprising an electronic cigarette (110), the electronic cigarette comprising:

a main body (112) having a first end (114) and a second end (116), the first end (114) comprising an atomizer connector (118) adapted to engage a mouthpiece (120), and the second end being adapted to receive a cap (122) with spring (124);

a power source (126) adapted to fit inside the main body;

an electronic control unit (128);

a housing (130) for storing the electronic control unit (128) and for electrically coupling the power source (126) and the atomizer connector (118), the housing adapted to fit inside the main body (112);

the electronic control unit (128) comprising:

a multidirectional joystick (132) adapted to operate and program the electronic cigarette (110), a visual indicator (134) adapted to provide a light signal, a USB connector (136) exposed from the main body (112) and adapted to provide computer connectivity, a controller (138) adapted to process input data from the joystick (132), and a memory (140) adapted to keep at least one vaping profile (156);

a mouthpiece (120) adapted to provide a path for a gaseous product, the mouthpiece (120) further comprising an atomizer (144) and a tank (146), the atomizer (144) is adapted to act as an electrical heating element, and the tank (146) being adapted to store an evaporable liquid solution;

wherein the USB connector (136) is adapted to receive information from a computer application (162); and wherein the joystick (132) is adapted to be directed in a plurality of directions for directing a user interface.

2. The real time variable voltage programmable electronic cigarette (110) of claim 1, wherein visual indicator (134) is a the tri-color RGB LED adapted to provide real-time status feedback from the electronic cigarette (110);

wherein the tri-color RGB LED is adapted to combine the three colors red, green and blue to produce colors other than red, green and blue; and wherein the tri-color LED has a transparent plastic piece used to reflect a light emitted outside the main body (112).

3. The real time voltage programmable electronic cigarette (110) of claim 2 wherein the visual indicator (134) is an RGB LED, and wherein it illuminates a default color and illuminates colors in a pattern to identify a status of the electronic cigarette (110).

4. The real time voltage programmable electronic cigarette (110) of claim 2, wherein the tri-color RGB LED is adapted to display a brightness that reflects the strength of energy applied to the atomizer (144).

5. The real time variable voltage programmable electronic cigarette (110) of claim 1, wherein the electronic cigarette (110) is programmable and adapted to create arbitrary waveforms (168) and save them to at least one vaping profile (156).

6. The real time variable voltage programmable electronic cigarette (110) of claim 5, wherein the electronic cigarette (110) is adapted to enable the user to set a voltage (152) and power (154) to be applied to the atomizer (144).

7. The real time variable voltage programmable electronic cigarette (110) of claim 5, wherein a desired voltage (152) setting and a desired power (154) setting are stored in the at least one vaping profile (156).

8. The real time variable voltage programmable electronic cigarette (110) of claim 5, wherein at least one vaping profile (156) can be saved to the memory (140).

9. The real time variable voltage programmable electronic cigarette (110) of claim 5, wherein at least one of the vaping profiles (156) can be reprogrammed.

10. The real time variable voltage programmable electronic cigarette (110) of claim 5, wherein the controller (138) is selected from the group consisting of proportional-integral-derivative controller, fuzzy logic, sliding controller, and state feedback.

11. The real time variable voltage programmable electronic cigarette (110) of claim 5, wherein the arbitrary waveforms (168) are oscillations and combinations of different levels of voltage (152) and power (154) in a span of time.

12. The real time variable voltage programmable electronic cigarette (110) of claim 11, wherein the voltage (152) is in the range of about 0 to 8V, and the power (154) is in the range of about 0 to 25 W.

13. The real time variable voltage programmable electronic cigarette (110) of claim 11, wherein each vaping profile (156) is limited by a duration of operation.

14. The real time variable voltage programmable electronic cigarette (110) of claim 13, wherein each vaping profile (156) is limited by 12 seconds of operation, after which the electronic cigarette (110) will automatically stop, and wherein the vaping profile (156) is defined by (120) points and every point represents 100 ms.

15. The real time variable voltage programmable electronic cigarette (110) of claim 5, wherein the electronic cigarette (110) is adapted to be programmed by a method selected from the group consisting of stand-alone programming on the electronic cigarette (110) and programming through the computer application (162).

16. The real time variable voltage programmable electronic cigarette (110) of claim 15, wherein standalone programming comprises programming by the joystick (132);

wherein standalone programming may be achieved by a manner selected from the group consisting of a) increasing or decreasing voltage (152) and power (154) by steps, the steps being 0.1V per step and 0.3 W per step, and b) increasing or decreasing continuously until a maximum voltage (152) and power 154 is reached or a minimum voltage (152) and power (154) is reached; and wherein the minimum voltage is 0V and the maximum voltage is 8V and the minimum power is 0 W and the maximum power is 25 W.

17. The real time voltage programmable electronic cigarette (110) of claim 1, wherein the atomizer connector (118) is a universal atomizer connector.

18. A method for delivering an evaporable substance comprising:

providing a real time variable voltage programmable electronic cigarette (110), the electronic cigarette (110) comprising:

a main body (112) having a first end (114), the first end (114) having an atomizer connector (118) and a second end (116) having a cap (122), the cap (122) having a spring (124) attached thereto, an opening for a power source (126) being located on the second end (116);

a housing (130) for housing the electronic control unit (128) and for electrically coupling the power source (126) and atomizer connector (118), the housing (130) adapted to fit inside the main body (112);

a USB connector (136) on a side of the main body (112), the USB connected adapted for communication with a computer application (162);

a joystick (132) located on a side of the main body (112) and aligned with a visual indicator (134);

a mouthpiece (120) detachably affixed to the first end (114) of the main body (112), the mouthpiece (120) defining a channel therein and being open at one end and further comprising an atomizer (144) and a tank (146);

the visual indicator (134) adapted to provide real time status feedback; and the joystick (132) configured to activate at least one vaping profile (156), the vaping profile (156) representing information to be communicated to the atomizer (144) directing the atomizer (144) to produce heat and information to be communicated to the visual indicator (134) to illuminate;

whereby heated air is directed into proximity with an evaporable substance located in the tank (146); and whereby at least a portion of the evaporable substance boils and produces a vapor, the vapor exiting the main body (112) by way of the mouthpiece (120).

19. The method of claim 18, wherein vaping profile comprises an arbitrary waveform (168) that defines a vaping energy applied to the atomizer (144);

wherein the vaping profile has a maximum duration of 12 seconds, the 12 seconds being defined by (120) points at 100 ms per point;

wherein the vaping profiles can be defined in terms of voltage (152) or of power (154);

wherein the definable voltage (152) range is 0V to 8V and the definable power (154) range is 0 to 25 W; and wherein the arbitrary waveform (168) defines an option for a user to define whether an amplitude of the vaping profile (156) will be defined in terms of voltage (152) or in terms of power (154).

20. The method of claim 19, wherein a user can define any desired waveform (168) within the definable voltage (152) and power (154) ranges using the computer application (162).

21. The method of claim 19, wherein the vaping profile (156) defines a color of a light shown from the visual indicator (134) while the visual indicator (134) is activated; and wherein the vaping profile has a maximum duration of 12 seconds, the 12 seconds being defined by (120) points at 100ms per point, wherein each point is defined by a color, and wherein the electronic cigarette (110) is adapted to allow a user to define a color for each point using the computer application (162).

22. The method of claim 18, wherein the vaping profile (156) defines a plurality of vaping modes (164), (166);

wherein the vaping modes (164), (166) are standard vaping mode (164) and a real time vaping mode (166); and wherein the real time variable voltage programmable electronic cigarette (110) is configured to a selected vaping mode (164),(166) by way of the computer application (162) or by way of a sequence of movements applied through the joystick (132).

23. The method of claim 22, wherein vaping profile (156) is in standard mode (164) when the joystick (132) is pushed center, up or down and wherein the vaping profile is in real time vaping mode (166) when the joystick (132) is pushed up down or center while the electronic cigarette (110) is in standard vaping mode (164).

24. The method of claim 18, wherein the atomizer connector (118) is a universal atomizer connector.

* * * * *